US006454255B1

(12) United States Patent
Allen et al.

(10) Patent No.: US 6,454,255 B1
(45) Date of Patent: Sep. 24, 2002

(54) RECIRCULATING GRIPPER ACCUMULATOR HAVING A CIRCULAR PAPER PATH

(75) Inventors: Robert J. Allen, Danbury; Michael S. Doery, Monroe; Thomas M. Lyga, Southbury; Francesco Porco, Fairfield, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 13 days.

(21) Appl. No.: 09/741,576

(22) Filed: Dec. 19, 2000

(51) Int. Cl.[7] ..... B65H 43/00

(52) U.S. Cl. ..... 271/176; 271/82; 271/277; 271/207; 271/213; 270/58.01; 270/58.02; 414/789.9

(58) Field of Search ..... 271/277, 82, 213, 271/176, 207; 270/58.02, 60, 13, 19, 58.01; 902/15; 414/789.9, 790.7

(56) References Cited

U.S. PATENT DOCUMENTS 4,822,018 A * 4/1989 Hain ..... 271/207
5,147,092 A 9/1992 Driscoll et al. ..... 271/184
5,346,203 A * 9/1994 Stemmle ..... 271/207
5,356,263 A 10/1994 Miller ..... 414/790.7
5,455,604 A * 10/1995 Adams et al. ..... 271/277
5,551,681 A * 9/1996 Ferrara ..... 270/58.01
6,077,030 A * 6/2000 Frochte et al. ..... 271/207

FOREIGN PATENT DOCUMENTS

JP 403279151 A * 12/1991 ..... 271/277

* cited by examiner

*Primary Examiner*—H. Grant Skaggs
(74) *Attorney, Agent, or Firm*—Ronald Reichman; Angelo Chaclas

(57) ABSTRACT

A sheet accumulator has a circular paper path and a compact design. Individual sheets of paper moving along a main linear path are diverted into the accumulator one by one, and each sheet enters a gripper having jaws that grip the sheets of paper. The gripper jaws pull the sheets along the circular paper path until the gripper returns to a home location, at which point the gripper stops, opens, accepts another sheet, closes, and makes another rotation. When the accumulation is complete, the gripper jaws open to release an accumulated stack of sheets, and a roller is then engaged to exit the sheets out of the accumulator and into the main linear paper path.

15 Claims, 7 Drawing Sheets

RECIRCULATING GRIPPER ACCUMULATOR HAVING A CIRCULAR PAPER PATH

CROSS REFERENCE TO RELATED APPLICATIONS

Reference is made to application Ser. No. 09/741,268, entitled SHEET ACCUMULATOR HAVING A CIRCULAR FEED PATH, assigned to the assignee of this application and filed on even date herewith.

TECHNICAL FIELD

This invention relates to paper sheet accumulators, and more specifically to a paper sheet accumulator wherein paper sheets are accumulated individually and then dispensed collectively as a stack.

BACKGROUND OF THE INVENTION

Numerous accumulators have been used for accumulating paper sheets and documents into stacks and then transporting the accumulated stacks. For instance, Driscoll et al. (U.S. Pat. No. 5,147,092) discloses a flat accumulator comprised of upper and lower sets of driven elastic belts.

Although a flat type of accumulator is appropriate for some applications, its dimensions are too large or bulky for other applications. This related art cannot conform to the space limitations and layout of certain machines in which a sheet accumulator must form a component part. In addition to problems of size and shape, the related art also has problems when accumulating paper that does not have normal buckling properties, such as perforated paper. For example, Miller, (U.S. Pat. No. 5,356,263) discloses a sheet accumulator in which it is necessary for sheets of paper to buckle very substantially, which becomes problematic when the sheet of paper has characteristics inconsistent with normal buckling (e.g. perforated paper). Another problem encountered with some of the related art is that the accumulation process may yield sheets that are out of order or inverted; in other words, the stack of paper produced may be either face down or lead-edge trailing relative to the input sheets of paper.

SUMMARY OF THE INVENTION

The main objective of this invention is to provide a sheet accumulator for accumulating sheets of paper one by one which arrive at the sheet accumulator along a main linear paper path, and for then allowing the stack of accumulated sheets to exit the accumulator. Another objective of the present invention is to minimize the amount of space required by the sheet accumulator. Accordingly, the present invention is a compactly designed sheet accumulator in which the paper path is circular. This design conforms to space limitations which other sheet accumulators, such as flat accumulators, are unable to achieve.

According to the present invention, individual sheets of paper moving along a main path enter into the accumulator one at a time, whereupon each sheet registers its lead edge against a backstop. Then a set of gripper jaws seizes the lead edge of that sheet of paper, while also seizing the lead edges of any other sheets of paper that are already registered against the backstop, whereupon the jaws pull all of the gripped sheets of paper along a circular path until the gripper jaws return to a home location. At the home location, the jaws open so as to accept an additional sheet of paper. The process repeats itself until a predetermined number of sheets are accumulated into a complete stack. Once this complete stack of sheets is registered against the backstop, the stack is exited out of the sheet accumulator into the main linear paper path.

The present invention is designed to offer an economical sheet accumulator with a compact configuration that allows the accumulator to fit into spaces where many other sheet accumulators cannot fit. The present invention is also designed in such a way as to easily handle paper prone to buckling, such as perforated paper.

DETAILED DESCRIPTION

Figure 1:
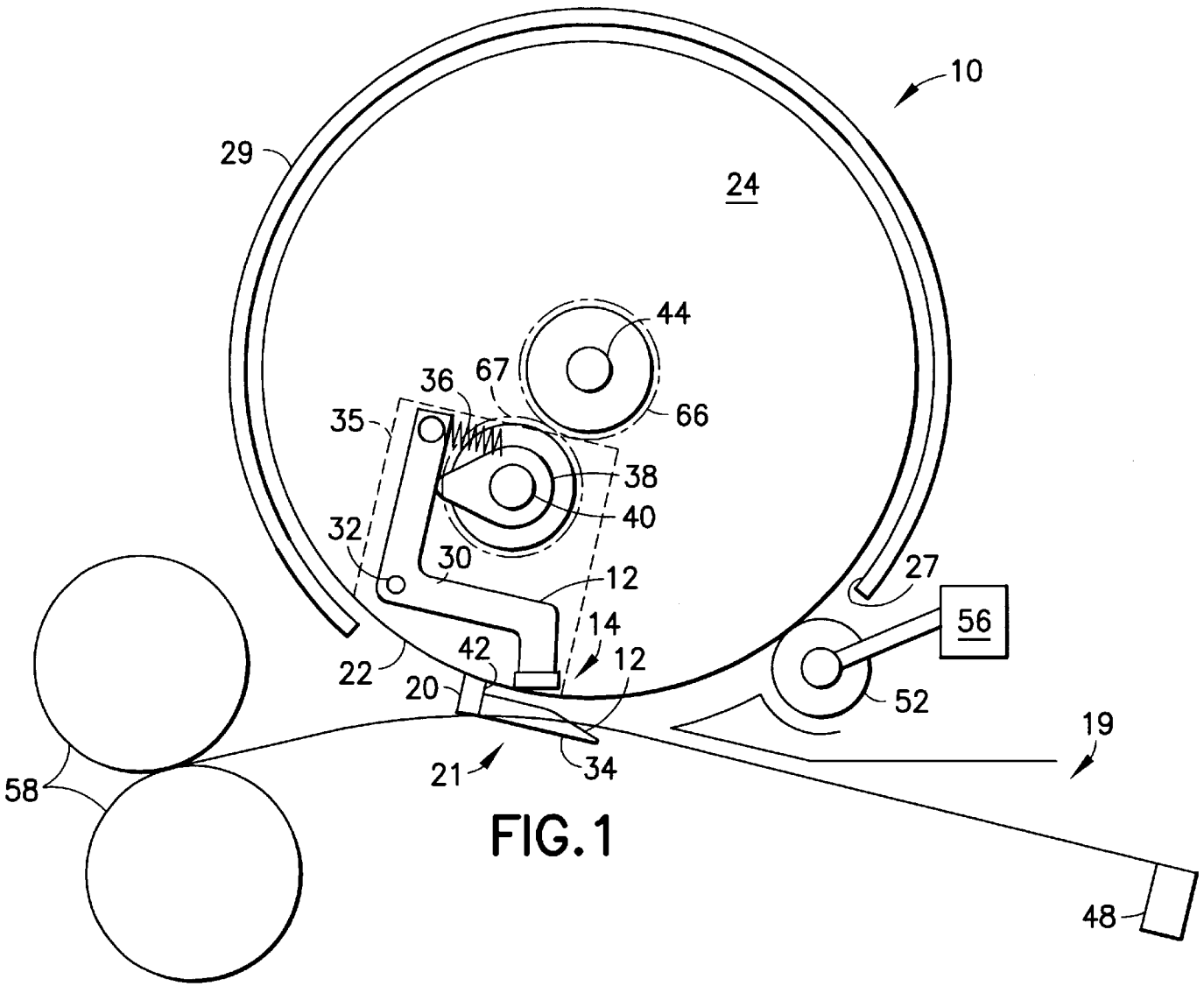
FIG. 1 is a side view of the sheet accumulator showing the paper guide, with the gripper jaws at the home location, ready to accept a sheet of paper.
Figure 2:
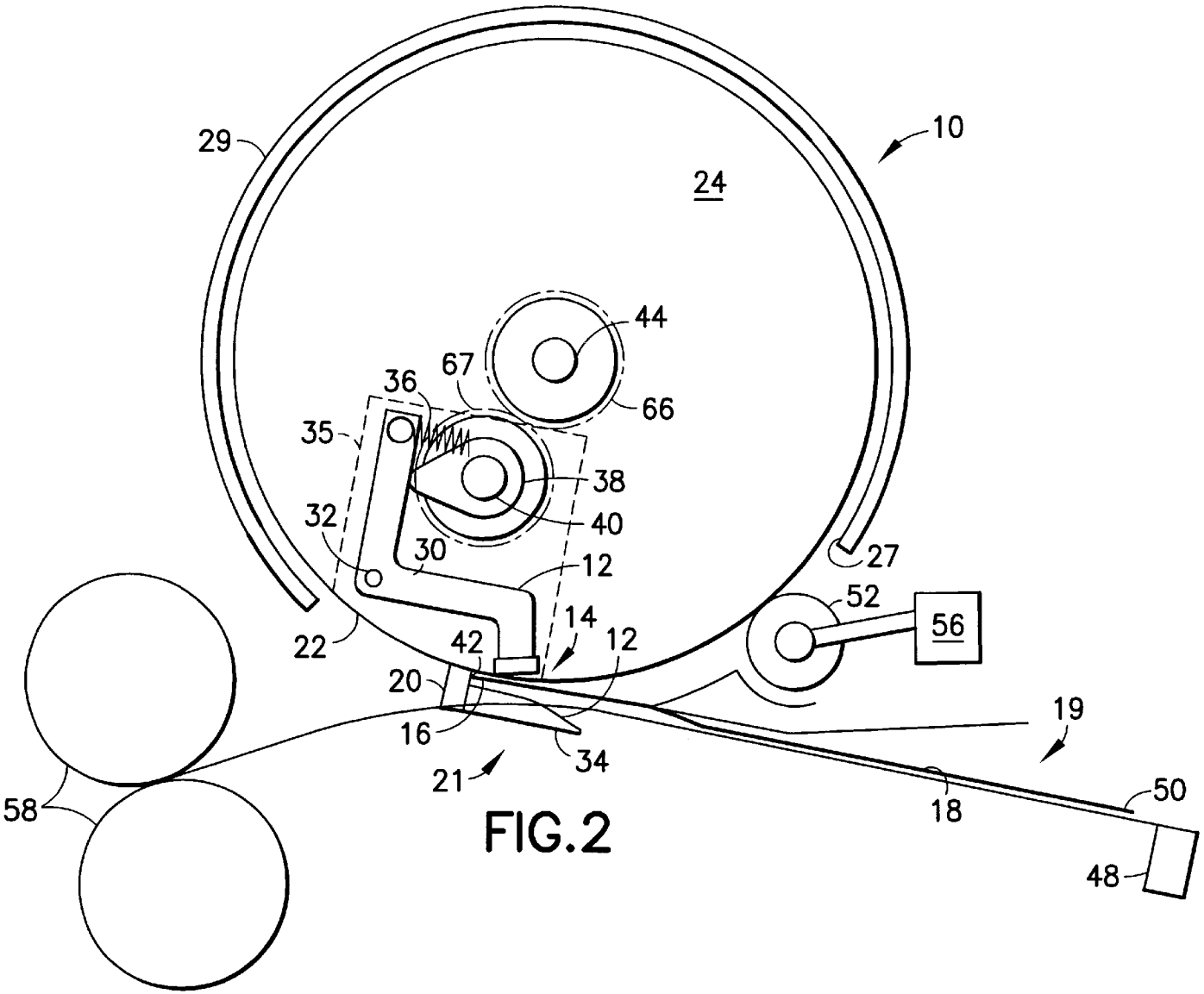
FIG. 2 is a side view of the sheet accumulator which has accepted an initial sheet of paper, with the gripper jaws again at the home location (the paper guide is again shown).

As best seen in FIGS. 1 and 2, the sheet accumulator 10 has gripper jaws 12 which define a mouth 14 for accepting the lead edge 16 of a sheet of paper 18. Each sheet of paper 18 that arrives at the entry point 19 of the sheet accumulator 10 enters the mouth 14, and registers against a backstop 20. The gripper jaws 12 are revolvable, and pull each sheet of paper 18 along a circular paper path defined by the outer perimeter 22 of a circular device 24, and the inner perimeter 27 of a circular paper guide 29.

Figure 3:
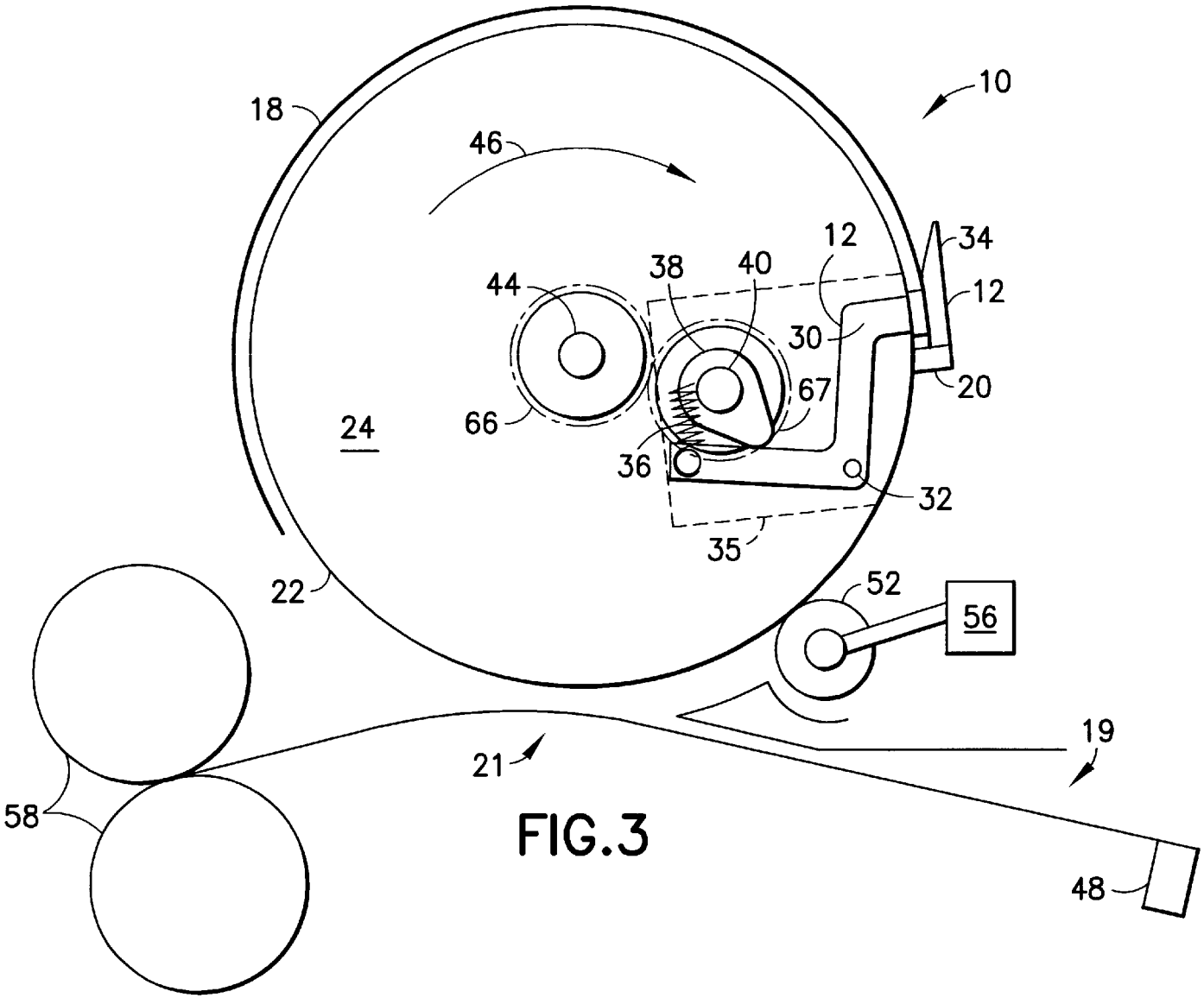
FIG. 3 is a side view of the sheet accumulator with the gripper jaws closed and the sheet of paper being pulled along a circular path (the paper guide is not shown).
Figure 4:
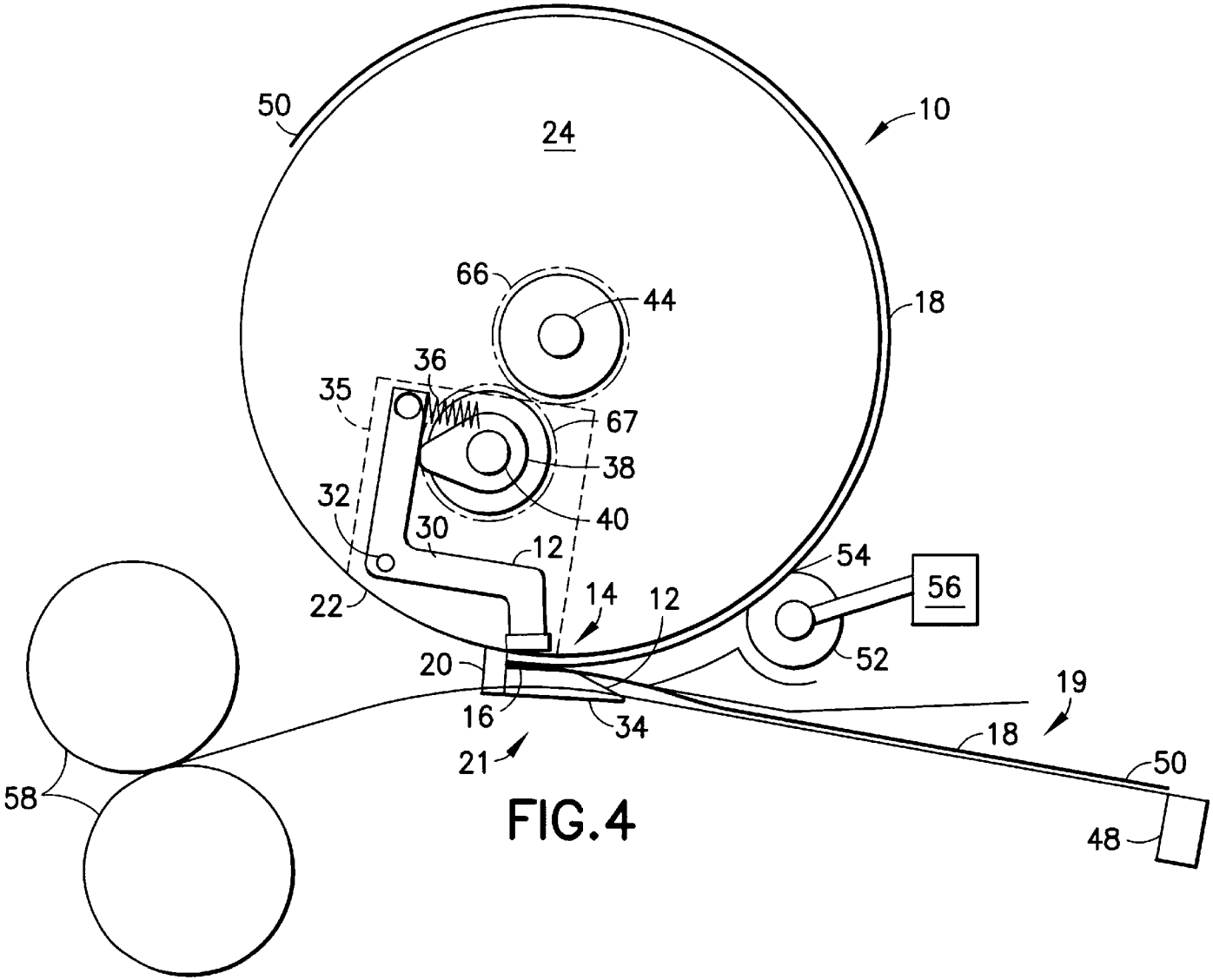
FIG. 4 is a side view of the sheet accumulator with the gripper jaws open, at the home location, and accepting an additional sheet of paper (the paper guide is not shown).

As best seen in FIGS. 3 and 4, the gripper jaws 12 pull each sheet of paper 18 as the gripper jaws revolve. When the gripper jaws 12 are open, they define a mouth 14 which is adjacent to the outer perimeter 22. While pulling each sheet of paper 18, the gripper jaws 12 are in a closed position so as to tightly grip the lead edge 16, as seen in FIG. 3. The mouth 14 opens after it revolves to a home location 21 where the jaws release the lead edge 16, as seen in FIG. 4.

Figure 5:
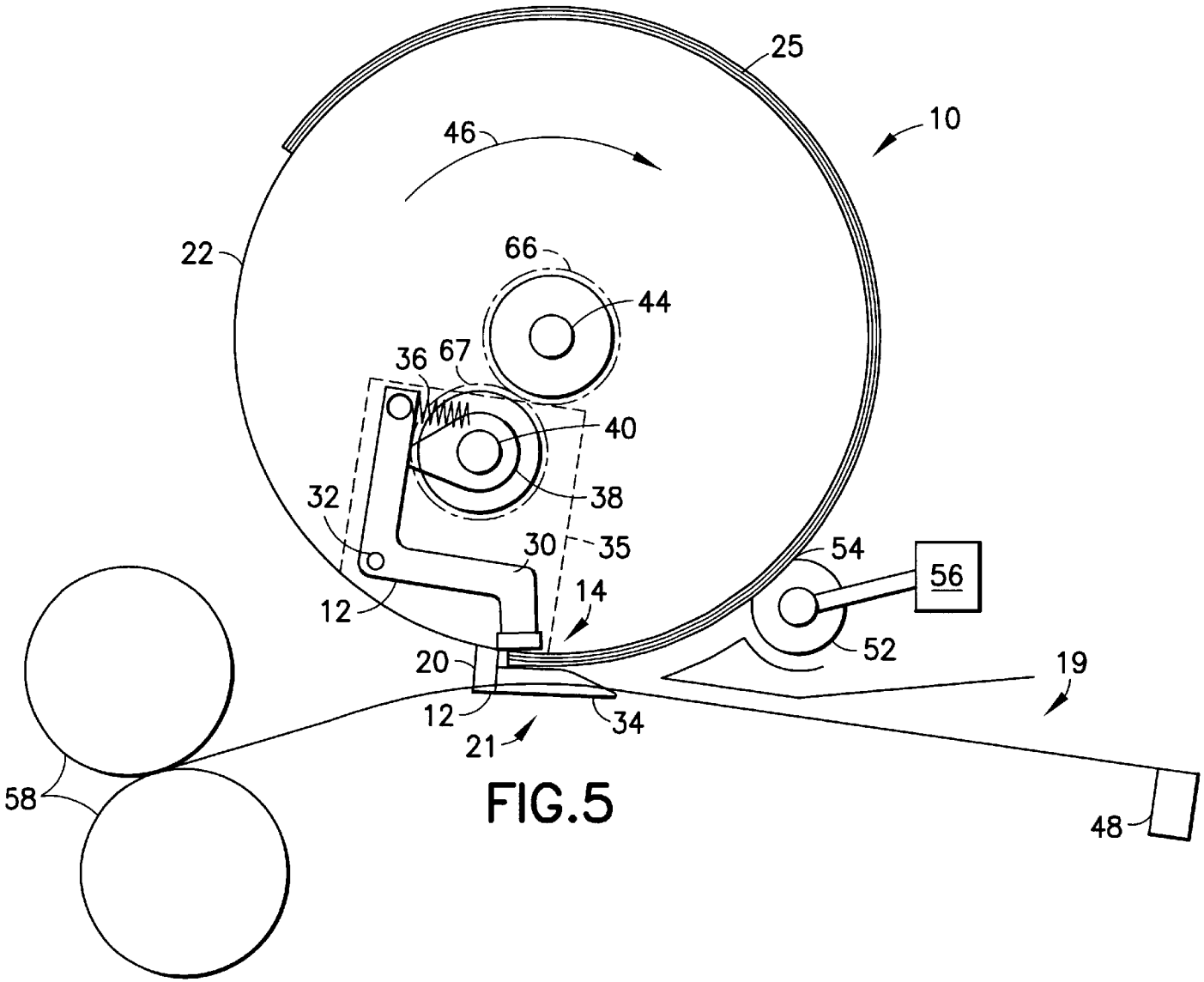
FIG. 5 is a side view of the sheet accumulator with the jaws ungripped at the home location (the paper guide is not shown).
Figure 6:
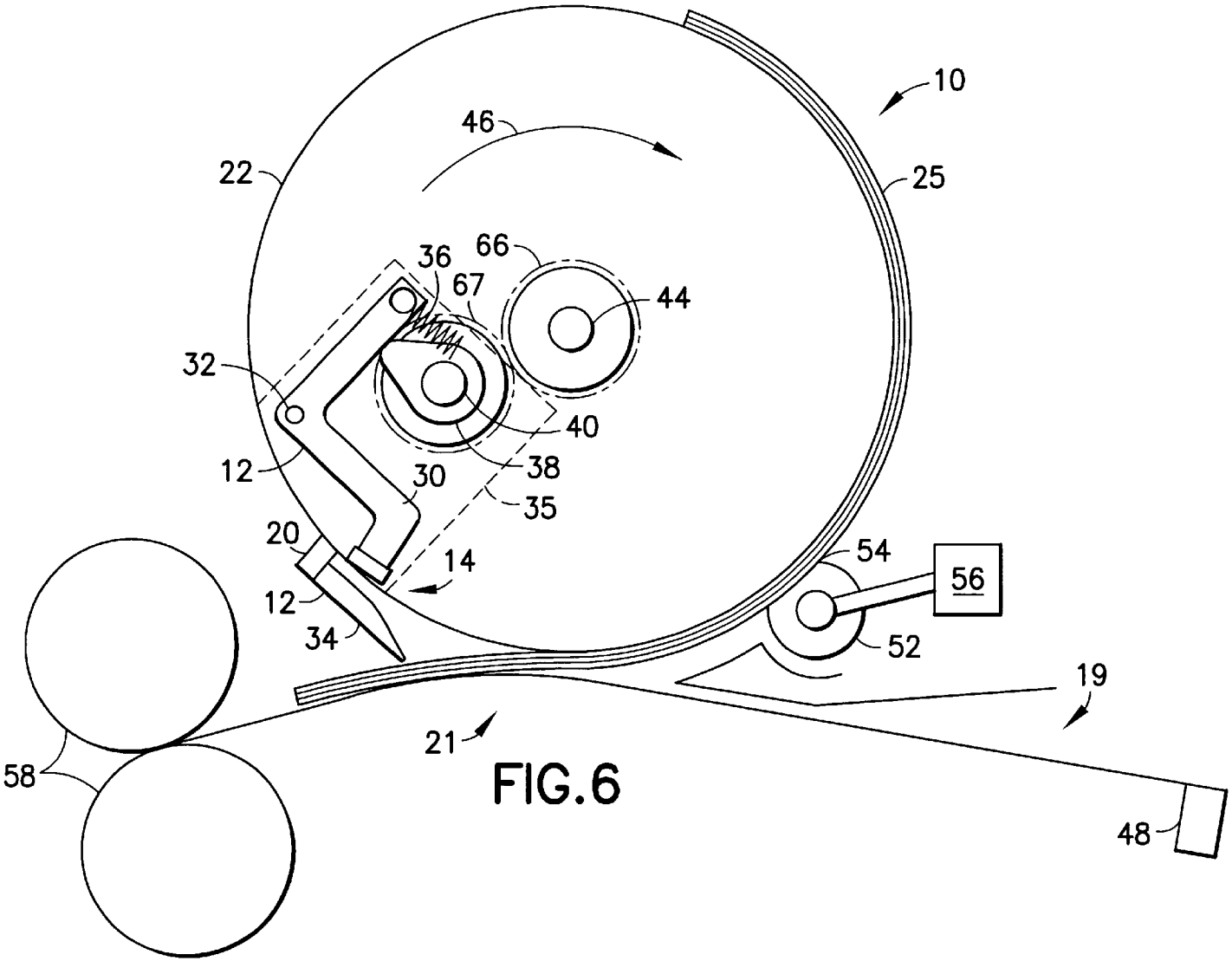
FIG. 6 is a side view of the sheet accumulator with the ungripped jaws revolved out of the way, enabling the stack of sheets to be exited out of the apparatus (the paper guide is not shown).

The backstop 20, against which each sheet of paper registers, is perpendicular to the outer perimeter 22 and extends outward from the outer perimeter 22. As best seen in FIGS. 4 and 5, sheets 18 enter the sheet accumulator 10 one by one, register against the backstop 20, and then all the sheets are pulled around the outer perimeter 22. As seen in FIG. 6, a complete stack of sheets 25 will exit the sheet accumulator 10 after a predetermined number of sheets have been ungripped by the gripper jaws 12.

Figure 7:
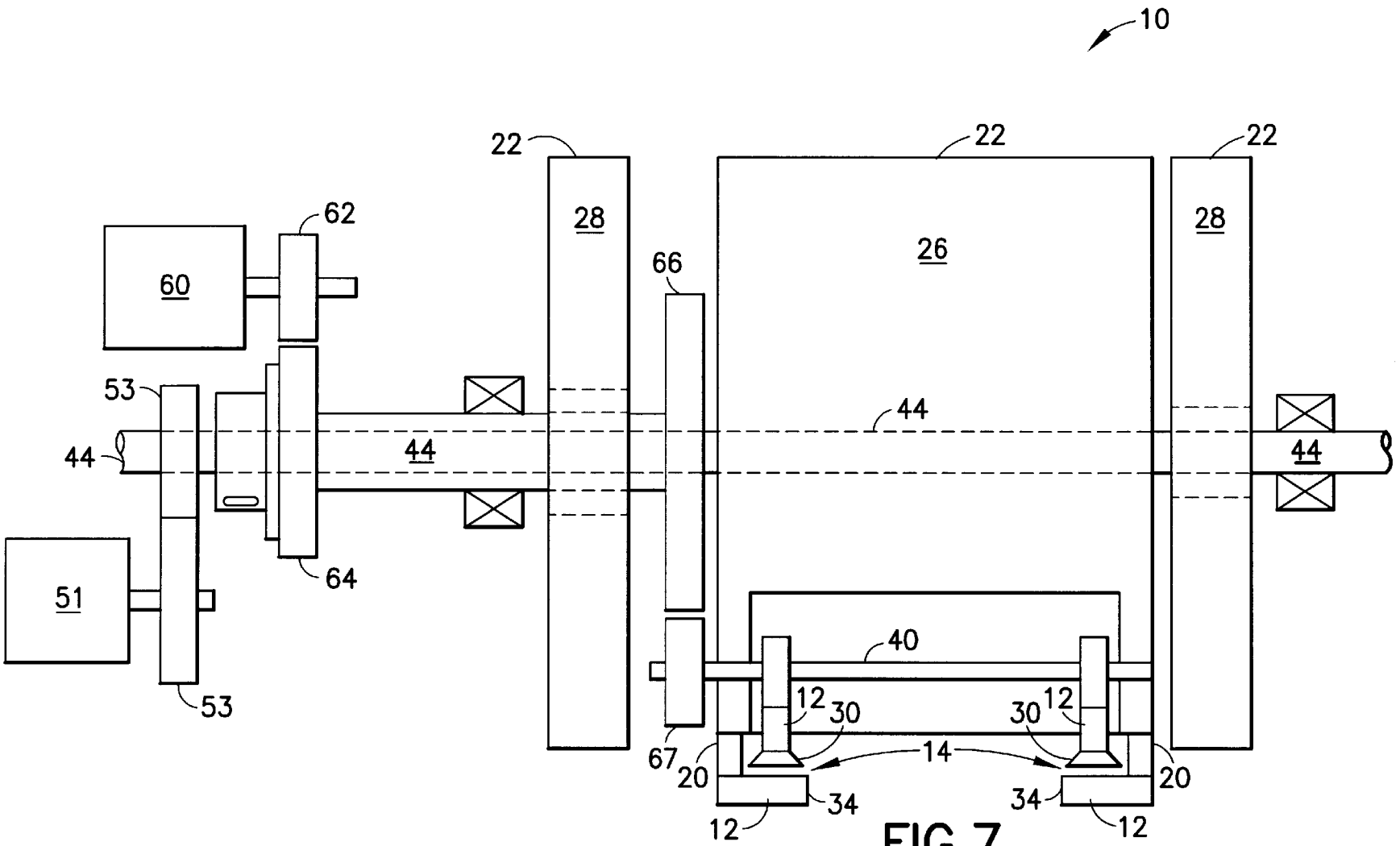
FIG. 7 is a front view of the sheet accumulator, with the jaws ungripped at the home location (the paper guide is not shown).

Further description of the best mode for operating the present invention can be seen in FIG. 7, which is a view from the front of the sheet accumulator 10, instead of a side view as in FIGS. 1–6. In FIG. 7, the mouth 14 is at the home location 21 and is open, as in FIGS. 1, 2, 4, and 5. FIG. 7 shows that the circular device 24 comprises a rotatable drum 26 and two rotatable disks 28, the mouth 14 being adjacent to the rotatable drum 26 and not adjacent to the two rotatable disks 28. The rotatable drum 26 and the two rotatable disks 28 all have substantially the same circumference as each other.

The mouth 14 of the gripper jaws 12 is opened and closed by movement of the inner jaw 30 only, while the outer jaw 34 remains stationary relative to the outer perimeter 22. The inner jaw 30 is attached to a pivot member 32, and the inner jaw 30 moves toward the outer jaw 34 by pivoting around the pivot member 32. This is best seen in FIGS. 3 and 4 where the mouth 14 is closed and open, respectively. The fact that the outer jaw 34 of FIG. 4 is pivoted with respect to the outer jaw 34 of FIG. 3 is easily seen with the help of the reference box 35. The inner jaw 30 is also attached to a spring 36 which urges the inner jaw 30 to pivot toward the outer jaw 34 and thus to close the mouth 14. The inner jaw 32 pivots away from the outer jaw 34, against the force of the spring 36, when a cam 38 forces the inner jaw 32 away from the rotation axis of the cam 38. The cam is attached to a cam shaft 40, as shown in FIG. 7, which rotates the cam 38 so as to open and close the mouth 14.

The sheet accumulator 10 operates in a repetitive manner, accumulating a stack of sheets 25 by accepting sheets one by one into the mouth 14 defined by the gripper jaws 12. Each sheet 18 stops when it hits the back throat 42, the back throat being the only surface of the backstop 20 that comes into contact with each sheet of paper 18. The back throat 42, the gripper jaws 12, the cam 38, the spring 36, the cam shaft 40, and the rotatable drum 26 are all coupled together and move in unison around the central drum shaft 44. The gripper jaws 12 grip a successively greater number of sheets until a predetermined number of sheets has revolved around the circular device 24 in the rotation direction 46. The gripper jaws 12 will always open and then close at the home location, except after a complete stack of sheets 25 is released, in which case the gripper jaws 12 will revolve away from the home position while remaining open, as best seen in FIG. 6.

In the embodiment of this sheet accumulator 10 shown in FIGS. 1–6, a sensor 48 detects when a sheet has registered against the backstop 20, so that the cam will then close the mouth 14. This sensor 48 can be situated at various places, such as near the trail edge 50 of the registered sheet of paper 18.

The rotatable disks 28 are free to rotate independently of the rotatable drum 26, the latter rotation being powered by a drum motor 51. The driven rollers 52 shown in FIGS. 1–6 form disk nips 54 with the rotatable disks 28, but do not form any nip with the rotatable drum 26 which rotates at angular velocities that differ from the angular velocities of the rotatable disks 28. The driven rollers 52 cause the rotatable disks 28 to rotate, the rotatable disks 28 otherwise rotating freely. The driven rollers 52 hold each sheet 18 securely in place whenever the mouth 14 is opened, by being actuated against the rotatable disks 28. The driven rollers 52 will be rotated and activated by a roller motor/actuator 56 when a complete stack of sheets 25 has been accumulated, so as to rotate the complete stack 25 away from the circular device 24 and into a set of takeaway rollers 58.

Because the cam shaft 40 is coupled to the rotatable drum 26, the cam shaft 40 will revolve whenever the drum motor 51 causes it to revolve via drum gears 53. However, the cam shaft 40 also requires an additional motor 60. The cam shaft 40, in addition to revolving around the central drum shaft 44, will also rotate so as to open and close the gripper jaws 12, and that rotation is powered by a separate cam rotation motor 60. Thus, this sheet accumulator requires at least three motors: the drum motor 51, the roller motor/actuator 56, and the cam rotation motor 60. Of course, any other driven rollers, for example the takeaway rollers 58, may be powered by supplementary motors.

As described thus far, the process by which collations are built can be thought of in two phases: a build phase and an exit phase. The build phase is a repetitive process involving a predetermined number of revolutions of the gripper jaws 12. The exit phase involves the gripper jaws 12 moving out of the way just once, so that the complete stack of sheets 25 can exit the apparatus via the takeaway rollers 58.

During the build phase, the cam rotation motor 60 enables the cam 38 to be rotated whenever the gripper jaws 12 are at the home location, utilizing concentric shafting, cam motor gears 62 coupled to an electromagnetic clutch 64, central cam shaft gears 66, and peripheral cam shaft gears 67. When the gripper jaws 12 are at the home location, the rotatable drum 26 is stationary, the electromagnetic clutch 64 is de-energized, and the cam shaft 40 is driven independently of the central drum shaft 44. Then, when the cam 38 rotates so as to close the gripper jaws 12, the electromagnetic clutch 64 is energized causing the cam shaft 40 and the central drum shaft 44 to rotate as one. This in essence preserves the relative configuration of the cam and the main drum.

It is noteworthy that the order in which each stack of sheets 25 is built preserves the order in which each sheet of paper 18 is generated and presented to the accumulator 10. For instance, if a collation of four sheets is generated and presented face up, the accumulator 10 will ensure that the stack of sheets 25 upon completion will have the sheets in the identical order and face up.

Certain changes may be made in the above construction without departing from the scope of the invention, as will be understood by those skilled in the art, and it is intended that all matter contained in the above description or shown in the accompanying drawings shall be interpreted as illustrative and not in a limiting sense.

What is claimed is:

1. A sheet accumulator comprising:

(a) a circular device having an outer perimeter;

(b) a backstop perpendicular to the outer perimeter of the circular device, extending outward from the outer perimeter, for stopping sheets of paper each of which enters the sheet accumulator one by one and registers a lead edge against the backstop;

(c) revolvable gripper jaws having a first open position and a second closed position, wherein the first open position defines a mouth adjacent to the outer perimeter of the circular device, and wherein the closed position is for seizing the lead edges of all the sheets of paper that have registered against the backstop whenever an additional sheet registers against the backstop, and for then pulling all the sheets of paper along a circular path adjacent to the outer perimeter of the circular device until the gripper jaws return to a home location where the gripper jaws move to the first open position;

(d) means for exiting a complete stack of sheets out of the sheet accumulator, after a predetermined number of sheets has been ungripped by the gripper jaws; and (e) means for causing the gripper jaws to revolve and to move between the first open position and the second closed position.

2. The sheet accumulator of claim 1, wherein the gripper jaws revolve away from the home location after ungripping the predetermined number of sheets, and before the complete stack of sheets exits the sheet accumulator.

3. The sheet accumulator of claim 1, further comprising a revolvable cam for holding the gripper jaws open against the force of a spring.

4. The sheet accumulator of claim 3, further comprising a sensing device, for enabling the cam to stop holding the gripper jaws open once each additional sheet is detected to have registered against the backstop.

5. The sheet accumulator of claim 1, wherein the backstop is revolvable, is coupled to the gripper jaws, and is located between the jaws so as to form the back throat of the jaws.

6. The sheet accumulator of claim 5, wherein the circular device comprises a rotatable drum to which the backstop and gripper jaws are coupled.

7. The sheet accumulator of claim 6, further comprising:

(a) a revolvable and rotatable cam for holding the gripper jaws open against the force of a spring;

(b) a revolvable and rotatable cam shaft for causing the cam to rotate, the cam shaft having a constant position relative to the rotatable drum; and a sensing device, for enabling the cam to stop holding the gripper jaws open once the additional sheet is detected to have registered against the backstop.

8. The sheet accumulator of claim 7, wherein the revolvable and rotatable cam shaft is caused to rotate by a fixed cam rotation motor, the rotatable drum is caused to rotate by a fixed drum motor, and the cam rotation motor is separate from the drum motor.

9. The sheet accumulator of claim 6, further comprising at least one roller adjacent to the outer perimeter of the circular device, for forming at least one nip through which the sheets of paper move.

10. The sheet accumulator of claim 9 wherein the at least one roller comprises at least one driven roller for holding the sheets of paper when the gripper jaws are at the home location, and for driving the complete stack of sheets out of the sheet accumulator.

11. The sheet accumulator of claim 10, further comprising an actuator for actuating the at least one driven roller toward the sheets of paper when the gripper jaw is at the home location, before the gripper jaws ungrip.

12. The sheet accumulator of claim 11, wherein the circular device further comprises two rotatable disks having a substantially similar circumference to the circumference of the rotatable drum.

13. The sheet accumulator of claim 12, wherein the rotatable drum is located between the rotatable disks and has the same axis of rotation as the rotatable disks.

14. The sheet accumulator of claim 13, wherein each of the at least one driven roller is actuated against the rotatable disks thus forming one of said at least one nip, and wherein the rotatable disks otherwise rotate freely and rotate independently of the rotatable drum.

15. The sheet accumulator of claim 1, wherein the predetermined number of sheets is a number selected by the user from a range of numbers.

* * * * *